US006029883A

United States Patent [19]

Hechinger et al.

[11] Patent Number: 6,029,883

[45] Date of Patent: Feb. 29, 2000

[54] ENVELOPE

[76] Inventors: Stanley L. Hechinger, 12467 W. Washington Blvd.; Charles H. Ellis, II, 3620 Grandview Blvd., both of Los Angeles, Calif. 90066; Stephen Robert Snook, P.O. Box 963, Chadron, Nebr. 69337

[21] Appl. No.: 08/979,430

[22] Filed: Nov. 26, 1997

[51] Int. Cl.[7] ..... B65D 27/04

[52] U.S. Cl. ..... 229/71

[58] Field of Search ..... 229/71, 303

[56] References Cited

U.S. PATENT DOCUMENTS

| | | | |
|---|---|---|---|
| 868,804 | 10/1907 | Peppler | 229/71 |
| 1,068,858 | 7/1913 | Cohn | 229/71 |
| 1,343,075 | 6/1920 | Benedict | 229/71 X |
| 1,988,908 | 1/1935 | MacKinnon | 229/71 |
| 3,221,980 | 12/1965 | Mercur | 229/71 |
| 3,380,648 | 4/1968 | De Lyra | 229/71 |
| 3,937,492 | 2/1976 | Biron | 229/303 X |
| 3,986,662 | 10/1976 | Luftig | 229/303 X |
| 4,829,568 | 5/1989 | Clark et al. | 380/23 |
| 5,418,205 | 5/1995 | Mehta et al. | 229/71 X |

FOREIGN PATENT DOCUMENTS

| | | | |
|---|---|---|---|
| 4001499 | 7/1991 | Germany | 229/71 |
| 111663 | 4/1989 | Japan | 229/71 |
| 6072446 | 3/1994 | Japan | 229/303 |
| 25986 | of 1904 | United Kingdom | 229/71 |

*Primary Examiner*—Jes F. Pascua
*Attorney, Agent, or Firm*—Colin P. Abrahams

[57] ABSTRACT

An envelope comprising a front portion and a rear portion. The front and rear portions define therebetween a space for receiving material, and one of the portions has a window therein located at a position for exposing postage indicia applied to the material within the space.

15 Claims, 4 Drawing Sheets

ENVELOPE

FIELD OF THE INVENTION

This invention relates to envelopes, and particularly envelopes including windows or apertures therein by means of which postage applied to material inside of the envelope is exposed through the window. The invention also relates to a method of applying postage to material to be included in an envelope and to show through a window therein, as well as a method of making such an envelope.

BACKGROUND OF THE INVENTION

Envelopes are a common and well-known means for transporting materials in the mail between parties. It is also well-known to have located on the envelope at least one window through which certain matter printed on the contents of the envelope can be seen. Typically, an envelope will include a window wherein the name of the addressee, printed on the inside material, will show through. The clear advantage of such an arrangement is that the envelope need not be addressed, saving a considerable amount of time, especially where a large amount of mail is sent.

Another window sometimes seen on an envelope is located and designed to expose a return address of the sender. This too has the advantage of time-saving procedures especially where bulk postage is concerned. Some envelopes may indeed have windows for both the addressee and return address of the sender.

In the prior art, there are also other instances of envelopes including windows for material other than the addressee or the return address. Usually, these windows are used in envelopes containing advertising or promotional material and may expose matter printed on the contents of the envelope designed to attract or compel the addressee, in order to gain attention.

Ongoing developments by both U.S. domestic and international postal authorities attempt to streamline and simplify the process of addressing, filling and applying postage to envelopes. There continue to be efforts on the part of the U.S. postal authorities to sell postage to users not only person-to-person at a post office and through the mail, but also through electronic means. Thus, it is established that postage can now be obtained from the U.S. postal authorities through telephone lines, and may be stored in various forms. Additionally, it is highly likely that postage will in future be obtainable for purchase on the Internet, using various security measures and personal identification numbers to protect against unauthorized usage and transactions. When postage is acquired over the Internet or electronic means, refills will be possible using electronic downloads, and the appropriate information as to the amount of postage obtained and used to date stored on a desk-top or other computer.

There is presently under development an electronic stamp which uses a desktop computer and printer in order to print postage. This postage may be printed directly onto the envelope, or it may be printed on special postage labels for later application onto the envelope by means of an adhesive. The ability of a computer to download and generate postage from an attached printer, as well as to monitor the amount of postage remaining in the computer, is an important development.

The present invention seeks to use these developments to further advantage, so that postage printed from a computer or other electronic source can be used more efficiently. It should, however, be noted that the present invention is not restricted to using such electronic postage, and may extend to postage produced by any other means.

SUMMARY OF THE INVENTION

According to one aspect of the invention there is provided an envelope comprising a front portion and a rear portion, the front and rear portions defining therebetween a space for receiving material, one of said portions having a window therein located at a position for exposing postage indicia applied to the material in the space.

The envelope may further comprise a window therein for exposing a name and address of an addressee, and a window for exposing a return address. Preferably, the postage indicia applied to the material is an electronically generated stamp, and is conveniently printed from a computer.

The window may have a covering which is sufficiently transparent so that postage indicia applied to material within the envelope is visible. Optionally, the covering incorporates a means for canceling the stamp, if necessary, and this may comprise a plurality of apertures in the window, or a pressure sensitive release coating in the window. The covering may comprise a glassine material, and may incorporate an anti-reflective means. The anti-reflective means may be achieved by mechanical treatment or chemical treatment. The covering may also incorporate security means to facilitate against copying or counterfeiting the postage indicia.

The window may be sufficiently large so as to also expose a name and address printed on the material, or sufficiently large so as to expose a name and address and return address printed on the material.

According to another aspect of the invention, there is provided a method of fabricating an envelope, the method comprising: providing a front portion and a rear portion defining therebetween a space, and forming a window on one of said portions located at a position to expose postage indicia applied to material contained within the envelope.

It is therefore an advantage of the invention to simplify mailing procedures by allowing application of the postage to the material contained within the envelope. In a typical usage, material to be mailed is printed, often generated by computer (such as that by utility companies), and the printed material contains not only the name of the addressee and the return address of the sender, but also the postage. By applying the postage to the material which are to be contents of the envelope, the contents need only to be placed in the envelope and nothing further is required prior to mailing. This would be the situation where the addressee and postage show through windows in the envelope.

Although the use of window envelopes having one or more windows for the purpose of exposing the addresses of the intended recipients and/or the sender of the enclosure are well known, it was not feasible until recently, with the proposal of electronic postage indicia which can be generated and imprinted by computer, that the present invention became possible. The present invention, which comprises the location of a window at that point for location on the envelope where the postage is normally applied, is feasible with the advent of the means being authorized by the postal authorities whereby the postage can be applied to the contents of the envelope.

It is also possible that the envelope have only one window for the postage and that an insert be placed within the envelope with the postage printed thereon. Thus, according to the configuration of the envelope used, the mailer will be saved from applying the postage to the outside of the envelope.

DETAILED DESCRIPTION OF THE PREFERRED EMBODIMENTS

Figure 1:
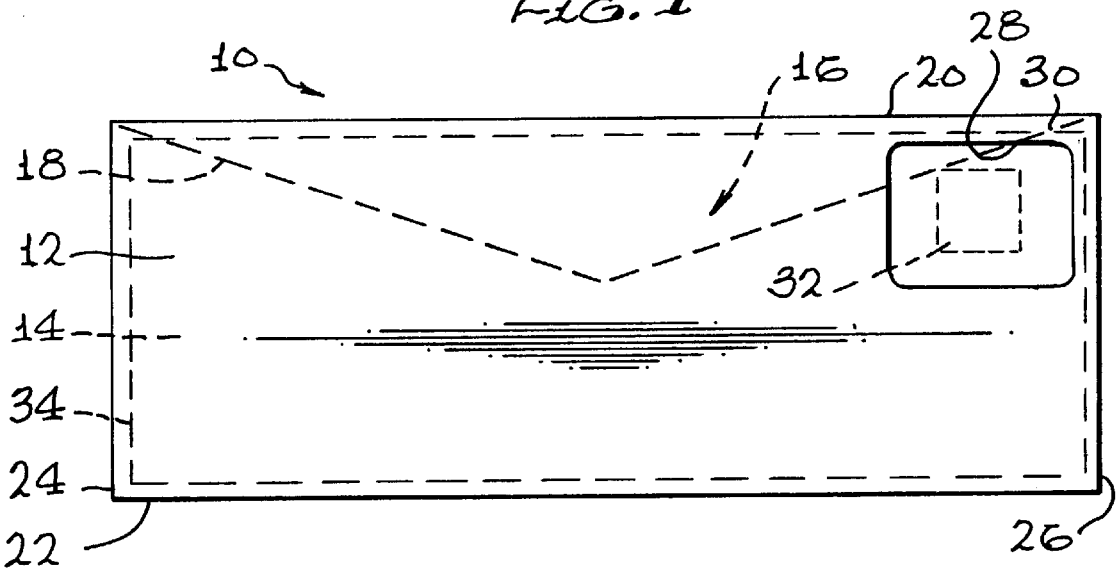
FIG. 1 is a front view of a first embodiment of the envelope of the invention including a postage window.

With reference to the drawings, FIG. 1 shows an envelope 10 of the invention including a front surface 12 and a rear surface 14. The front and rear surfaces 12 and 14 respectively define therebetween a space for receiving the contents or material 34. The rear surface 14 includes a flap 18 which can be opened and closed to provide access to the space 16 within the envelope 10. When the contents or material to be mailed have been placed within the envelope, the flap 18 may be pasted, by appropriate means, to the rear surface 14, thereby sealing the contents of the envelope 10.

The envelope includes an upper edge 20, a lower edge 22, a left side edge 24 and a right side edge 26.

A window 28 is provided in the front surface 12 of the envelope 10, the window being located in the upper right hand corner 30, near the upper edge 20 and the right side edge 26. The window is designed so as to be located and of sufficiently large size to expose a postage stamp or other postage indicia on material within the envelope. The postage indicia, hereafter referred to as a postage stamp or stamp 32, is shown in phantom lines, the postage stamp 32 being located on contents 34 of the envelope 10. The contents 34 may comprise a special insert sheet with the postage only, or it may be part of the documents being mailed to the addressee and incorporate a postage stamp 32 thereon, located during the printing process to ensure that the contents, when folded, expose the stamp 32 through the window 28.

Reference is now made to FIGS. 2 to 14 in the accompanying drawings which show variations or embodiments of the envelope of the invention. In these embodiments, like numerals have been assigned to like elements of the invention for ease of reference.

Figure 2:
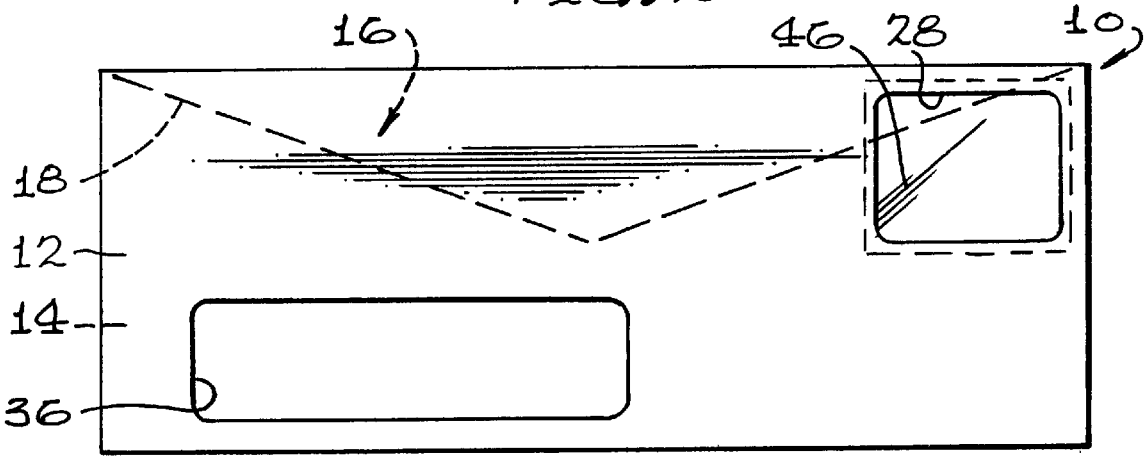
FIG. 2 is a front view of a second embodiment of the envelope of the invention including a postage window.

While FIG. 1 shows a basic envelope with only one window for exposing a postage stamp 32, FIG. 2 shows the alternative embodiment including an address window 36 through which the name and address of the address can be seen. The name and address would typically be printed on the contents 34, upon which the stamp 32 is also printed. However, the stamp 32 may be printed on separate materials to that on which the name and address is printed.

Figure 3:
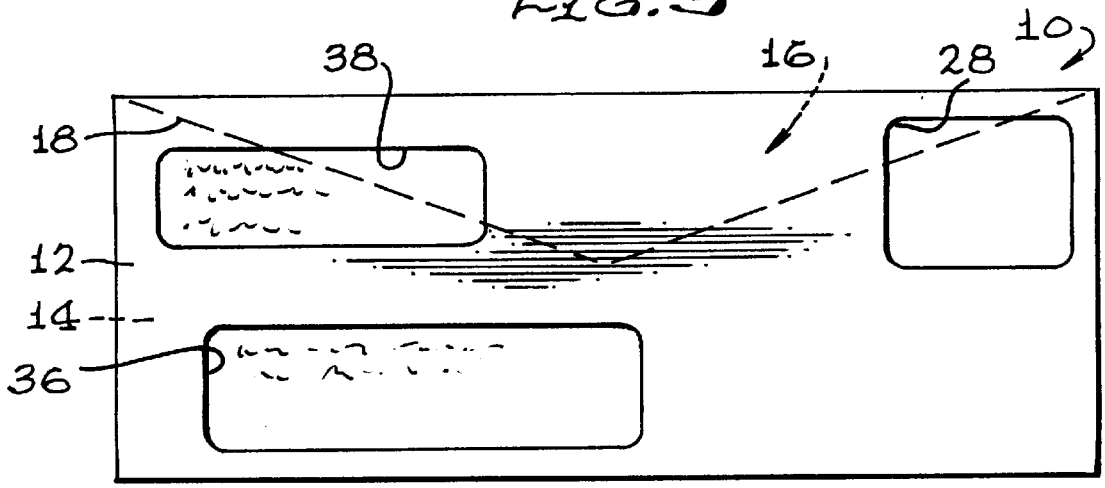
FIG. 3 is a front view of a third embodiment of the envelope of the invention including a postage window.
Figure 4:
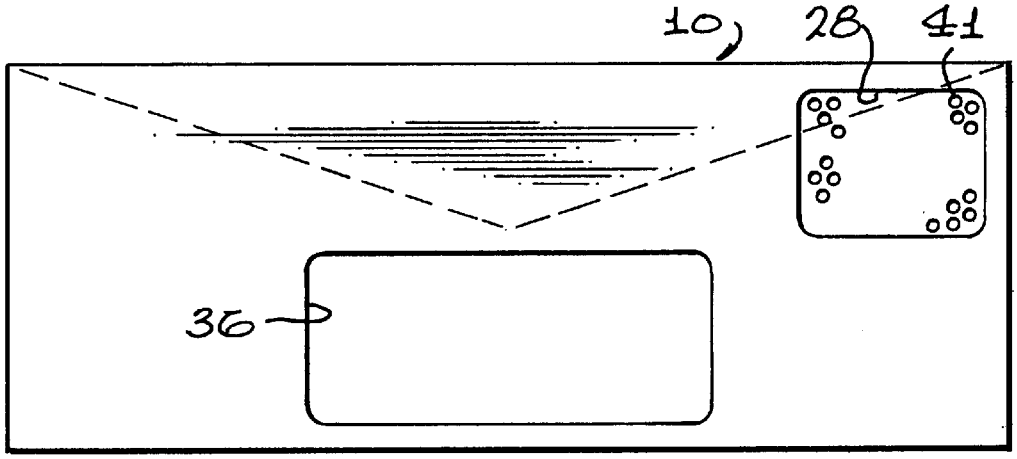
FIG. 4 is a front view of a fourth embodiment of the envelope of the invention including a postage window.
Figure 5:
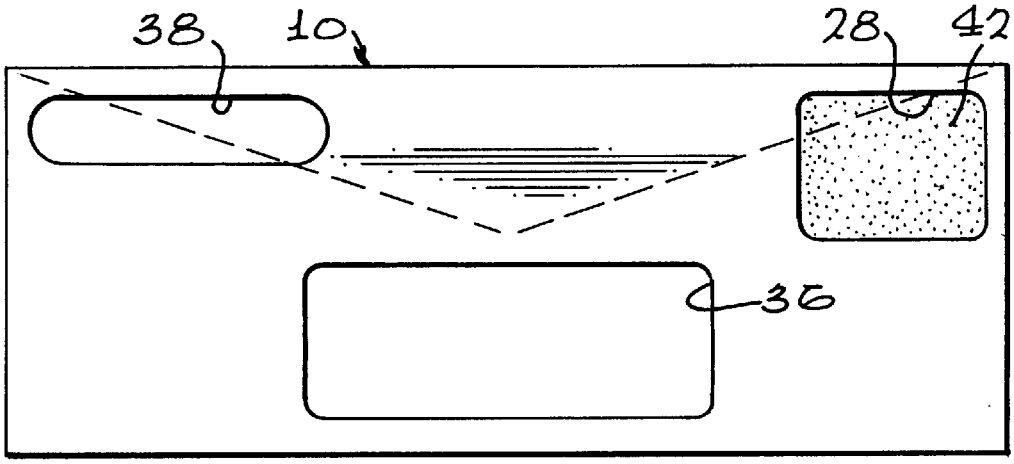
FIG. 5 is a front view of a fifth embodiment of the envelope of the invention including a postage window.

In FIG. 3, the envelope 10 also incorporates a return address window 38, in addition to the addressee window 36 and postage window 28. In FIGS. 2 and 3, the address window 36 and return address window 38 are located towards the left side edge 24 on the front surface 12 of the envelope 10. FIGS. 4 and 5 show slight variations of this embodiment wherein the address window, shown in FIGS. 4 and 5, is located more or less in the center of the front surface 12 of the envelope 10, and towards the lower edge 22. In FIG. 5, which shows both an addressee window 36 and a return address window 38, the addressee window 36 is shown in the same position as that in FIG. 4, while a smaller return address window 38 is once more shown near the upper left corner of the front surface 12 of the envelope, the customary position for having such a return address.

Figure 6:
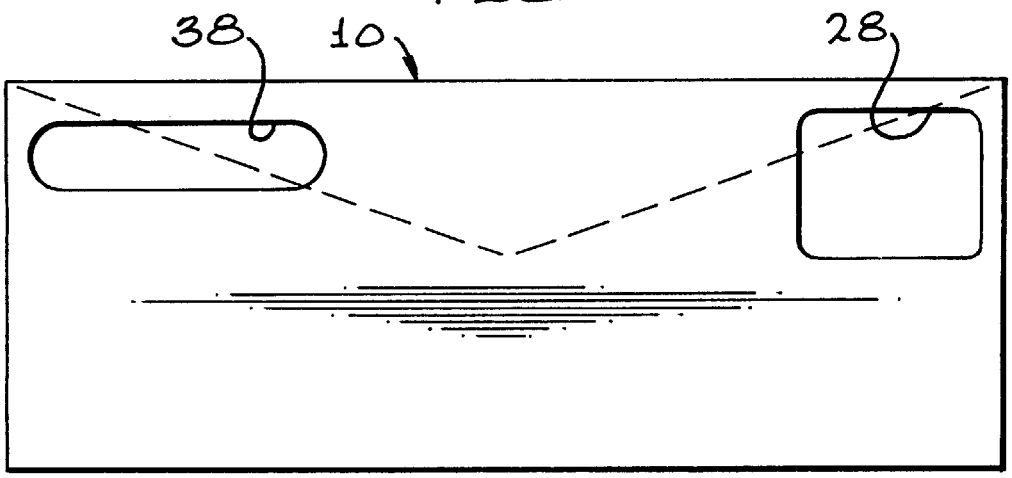
FIG. 6 is a front view of a sixth embodiment of the envelope of the invention including a postage window.

FIG. 6 shows the embodiment where the addressee window 36 is omitted, but the envelope contains both a postage window 28 and a return address window 38.

Figure 7:
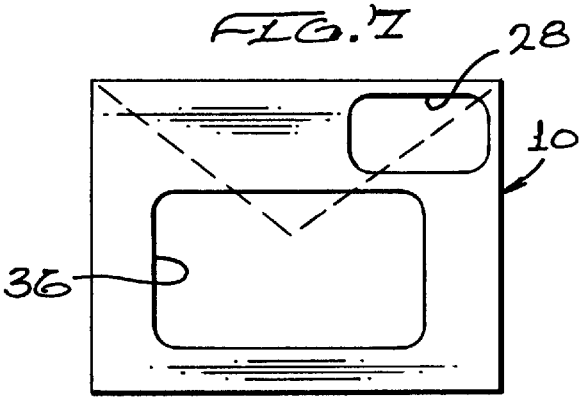
FIG. 7 is a front view of a seventh embodiment of the envelope of the invention including a postage window.

FIG. 7 shows an envelope 10 of different shape, and may be an envelope which is typically used for invoices or other statement of account documents. The envelope 10 in FIG. 7 includes a postage window 28 and an address window 36.

Figure 8:
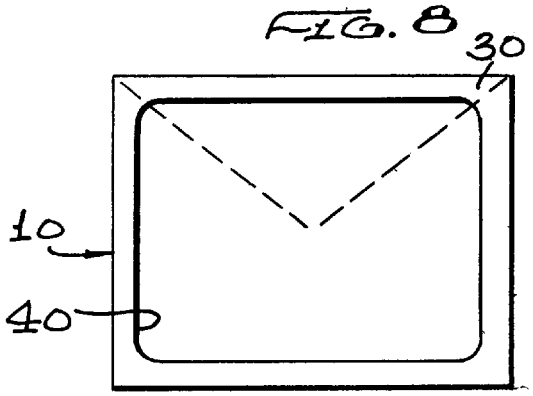
FIG. 8 is a front view of a eighth embodiment of the envelope of the invention including a postage window.

FIG. 8 shows yet a further embodiment of an envelope 10, but with one large window 40 which is of sufficient dimension to expose the postage, return address, and/or addressee name and address. Importantly, the window 40 in the envelope 10 of FIG. 8 extends towards the upper right hand corner 30 so as to encompass that area on which the postage customarily is applied.

Figure 9:
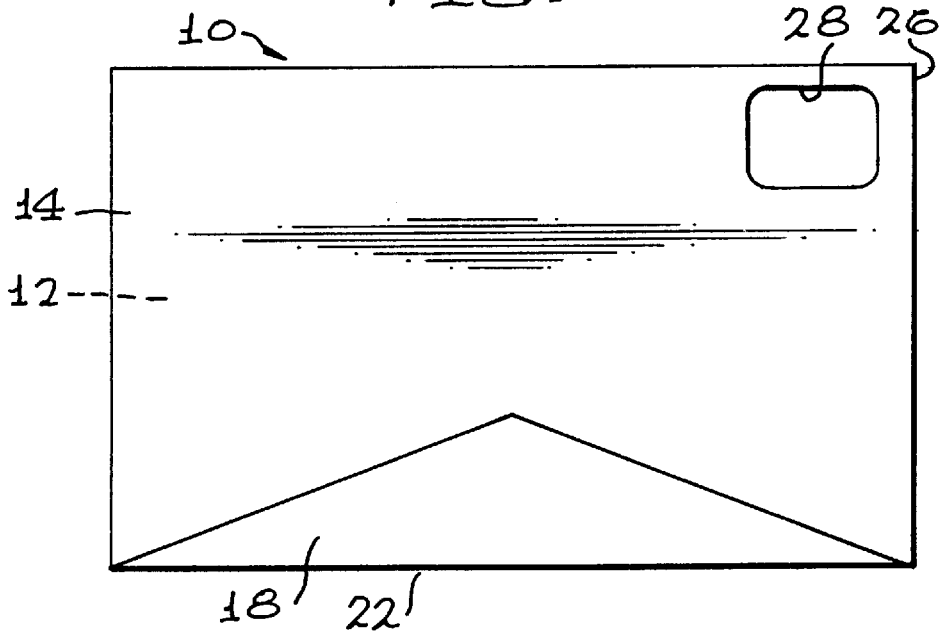
FIG. 9 is a front view of a ninth embodiment of the envelope of the invention including a postage window.

FIG. 9 shows a larger envelope, for example one for accommodating an unfolded letter or legal size paper. In this particular envelope 10, the flap 18 is located along the lower edge 26 of the envelope, as opposed to the upper edge 20 in the case of the previous embodiments described. The envelope 10 in FIG. 9 has a single postage window 28, in this embodiment located on the rear surface of the envelope, for exposing a stamp or postage as previously described.

Figure 10:
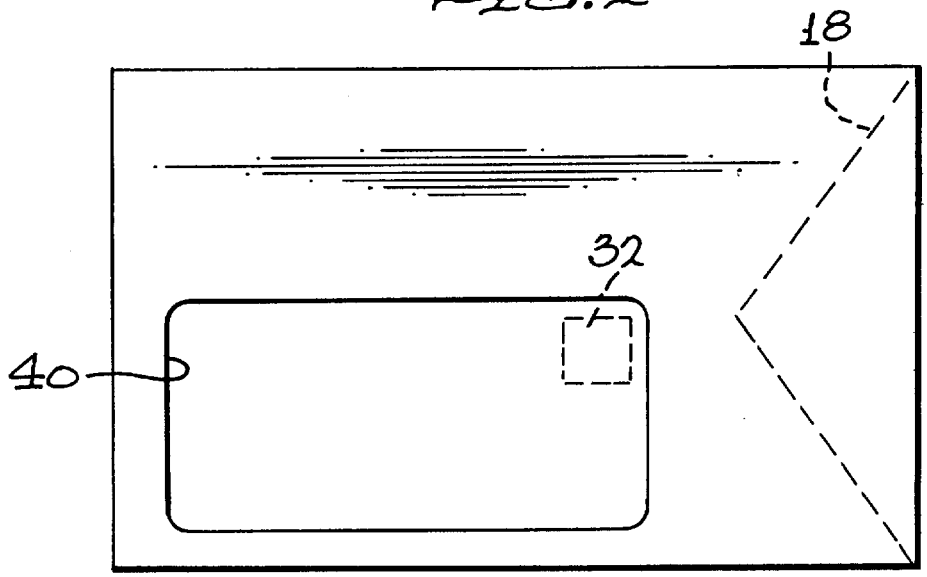
FIG. 10 is a front view of a tenth embodiment of the envelope of the invention including a postage window.

FIG. 10 shows an envelope which includes an address window 40, which is designed to show or expose the postage stamp 32. The window 40 is located on the front surface of the envlope.

Figure 11:
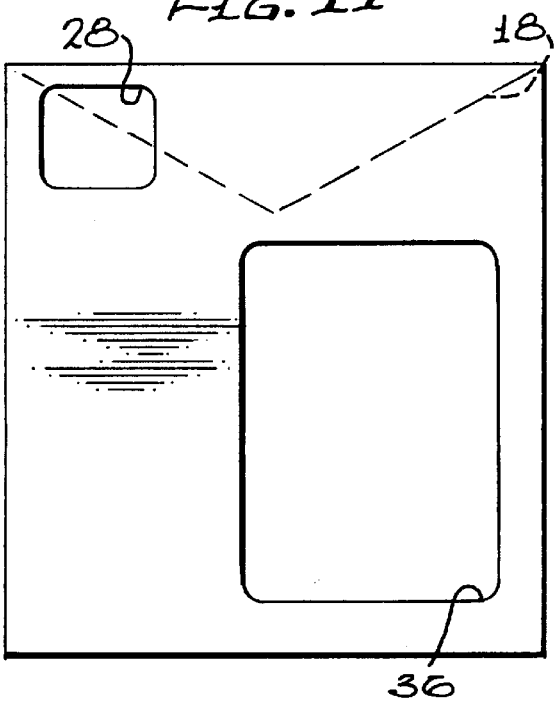
FIG. 11 is a front view of an eleventh embodiment of the envelope of the invention including a postage window.
Figure 12:
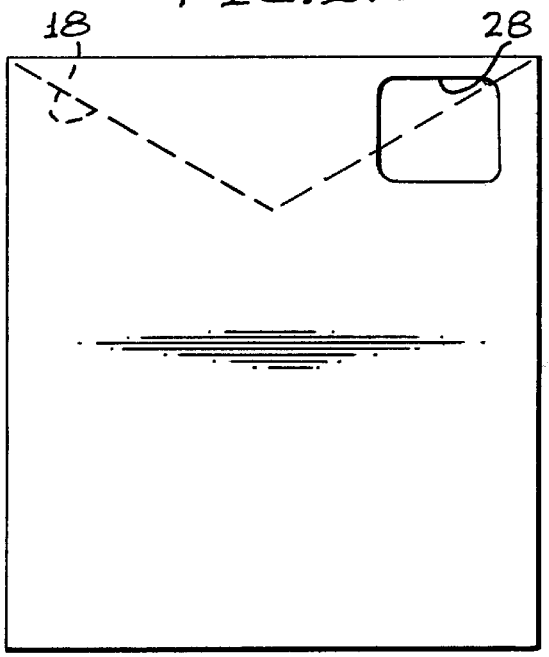
FIG. 12 is a front view of a twelfth embodiment of the envelope of the invention including a postage window.

FIGS. 11 and 12 show yet further embodiments of the invention. FIG. 11 includes a postage window 28 and an address window 36 oriented at right angles with respect to the flap 18. In FIG. 12, only a postage window 28 is shown, in another position, but one which would be acceptable for the purposes of meeting the requirements of the postal authorities.

Figure 13:
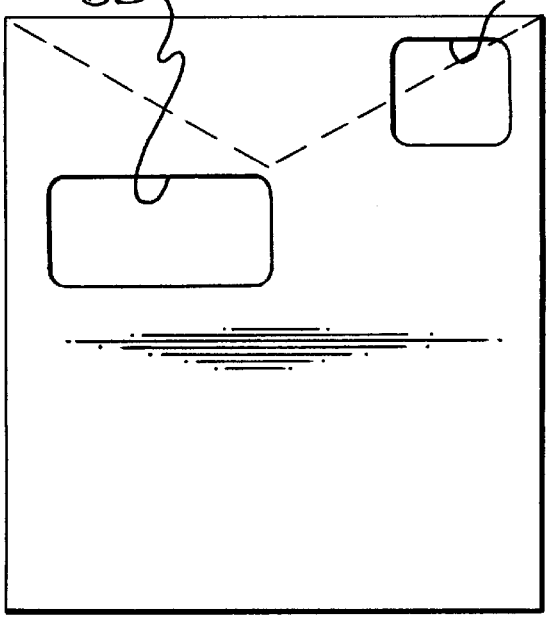
FIG. 13 is a front view of a thirteenth embodiment of the envelope of the invention including a postage window.
Figure 14:
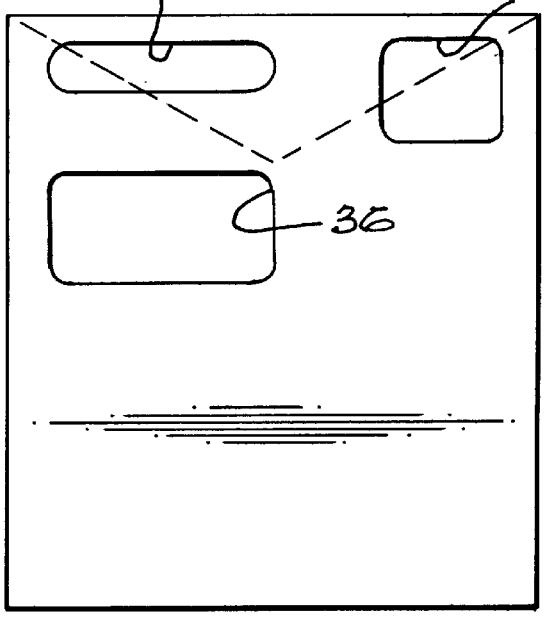
FIG. 14 is a front view of a fourteenth embodiment of the envelope of the invention including a postage window.

FIGS. 13 and 14 are very similar to that embodiment shown in FIG. 12, with FIG. 13 showing in addition to a postage window, the address window 36, while FIG. 14 shows the addition of the return address window 38.

In the embodiments above, the various windows described, and particularly the postage window 28, may take a number of forms. In one example, the window may be nothing more than an aperture in the envelope so that the postage printed on the contents can be directly viewed and is directly accessible from outside of the envelope. In another form, the window may comprise an appropriately sized opening but include a transparent or semi-transparent material through which the printed postage (or address or return address for the other windows) can be easily viewed. The transparent covering material 46, shown in FIG. 2, may be chosen so that only selected portions of its surface are transparent, thereby permitting some of the contents to be seen through the window, but maintaining other material of the contents covered so as to ensure privacy, as appropriate.

The transparent or semi-transparent window coverings may also incorporate other features and characteristics which would enhance machine readability and permit appropriate security. Such characteristics may include anti-reflective treatments to ensure that the postage imprinted on the contents can be easily machine read. Certain security measures may include the provision of watermarks, color tinting or holograms on the covering of the window. The window covering, particularly for those windows exposing for view the postage printed on the contents of the envelope, may be provided to enable the postal authorities to cancel the postage or otherwise invalidate it for possible future usage. Such means may include, for example, one or a plurality of small holes or apertures 41 through which ink applied over the postage stamp will penetrate the covering and cancel the printed stamp. Other examples include a covering which is in a form of a "carbonless" type film whereby an impression applied to the outside of the envelope by the postal authorities upon a pressure sensitive release coating 42 in the window will print on the postage so as to prevent the possibility of future use. Any other suitable way of cancelling or rendering the stamp invalid for future use may be applied, such as marking the stamp in any way by use of pressure, light or other form.

By incorporating a window in the envelope to expose and facilitate the use and monitoring of the postage, by both human and mechanical means, the postage, including a stamp or electronic indicia, can be applied to the enclosure within the envelope, and eliminate the need to affix a stamp to the envelope, or to run the envelope through a postage meter. Significant savings in time and labor, particularly for large mailers, provides a clear advantage. Thus, large mailers, such as utility companies and other enterprises which send out many identical envelopes each month, each having only one or a very limited number of pages, and where the postage can be calculated in advance, can at the same time provide the name and address of the recipient, the return address, as well as the postage, and all of these have appropriate windows in the envelope whereby they are exposed for proper delivery of the document.

The covering material for the window is preferably secured to the inside of the envelope, although in certain embodiments it may be secured to the outside thereof. The window covering may be a semi-transparent material such as glassine paper, as is customary or a transparent material, examples of which are Cellophane® or Mylar®. The covering material may be tinted, have anti-reflective means, the anti-reflective means being achieved by either a mechanical or chemical treatment process. Such processes are well-known in the art and will not be described here.

The covering of the window, or indeed the entire envelope, may be fabricated of transparent or semi-transparent material which may have its transmissivity reduced, and this may be achieved by mechanical means or imprinting with a substance. Where mechanical, the transmissivity is reduced by distortion of the surface, for example, by hot or cold stamping, and ablation by electric discharge or abrasive blasting. Alternatively, transmissivity may be reduced by chemical processes of the material, and this may comprise a direct application of the chemical substance on the window, or indirect alteration of the chemical structure of the material by exposure to radiation including infra-red, ultra-violet and nuclear radiation or a combination thereof.

As mentioned above, the window may include a water mark, and this may incorporate security means to reduce the likelihood of copying or counterfeiting the postage applied to the enclosure. The water mark may be in the form of a hologram, or impressed by mechanical means. Chemical or photographic processes may also be used. Furthermore, the water mark may incorporate encoded information to be machine read, and this information may identify the sender, or provide other relevant data.

The invention also relates to a method whereby an electronic postage indicia such as a stamp or machine imprint is applied to the enclosure within an envelope, and providing a window in the envelope whereby the electronic postage indicia is exposed once the material, either folded or unfolded, is placed in the envelope.

We claim:

1. An envelope package comprising an envelope having a front portion and a rear portion, the front and rear portions defining therebetween a space, material contained within the space, said material including computer generated and printed postage indicia, one of said front or rear portions having a window therein located at a position for exposing the computer generated and printed postage indica portion of the message applied to the material in the space, wherein the window has a covering which is sufficiently transparent so that the postage indicia applied to the material is visible, the covering incorporating a plurality of apertures in the window.

2. An envelope as claimed in claim 1 further comprising a window therein for exposing a name and address of an addressee.

3. An envelope as claimed in claim 1 further comprising a window for exposing a return address.

4. An envelope as claimed in claim 1 wherein the electronically generated stamp is printed from a computer.

5. An envelope as claimed in claim 1 wherein the window has a covering, the covering being sufficiently transparent so that postage indicia applied to the material is visible.

6. An envelope as claimed in claim 5 wherein the covering incorporates a means for canceling the stamp.

7. An envelope as claimed in claim 6 wherein the means for canceling the stamp comprises a plurality of apertures in the window.

8. An envelope as claimed in claim 6 wherein the means for canceling the stamp comprises a pressure sensitive release coating in the window.

9. An envelope as claimed in claim 6 wherein the covering incorporates security means to facilitate against copying or counterfeiting the postage indicia.

10. An envelope as claimed in claim 5 wherein the covering comprises a glassine material.

11. An envelope as claimed in claim 5 wherein the covering incorporates an anti-reflective means.

12. An envelope as claimed in claim 11 wherein the anti-reflective means is achieved by one of the following: mechanical treatment and chemical treatment.

13. An envelope as claimed in claim 1 wherein the window is located in an upper right-hand portion of the envelope.

14. An envelope as claimed in claim 1 wherein the window is sufficiently large so as to expose a name and address printed on the material.

15. An envelope as claimed in claim 1 wherein the window is sufficiently large so as to expose a name and address and return address printed on the material.

* * * * *